US007559884B2

(12) United States Patent
Kisch

(10) Patent No.: US 7,559,884 B2
(45) Date of Patent: Jul. 14, 2009

(54) SMART MANDREL FOR CONTAINER FORMING MACHINES

(76) Inventor: Raymond George Montague Kisch, 2170 Academy Ave., Sanger, CA (US) 93710

( * ) Notice: Subject to any disclaimer, the term of this patent is extended or adjusted under 35 U.S.C. 154(b) by 0 days.

(21) Appl. No.: 11/810,286

(22) Filed: Jun. 5, 2007

(65) Prior Publication Data

US 2008/0032878 A1 Feb. 7, 2008

Related U.S. Application Data

(60) Provisional application No. 60/811,979, filed on Jun. 8, 2006.

(51) Int. Cl.
*B31B 1/30* (2006.01)
*B31B 1/46* (2006.01)

(52) U.S. Cl. ..... 493/175; 493/89; 493/167

(58) Field of Classification Search ..... 493/89, 493/92, 98, 167–169, 174–176
See application file for complete search history.

(56) References Cited

U.S. PATENT DOCUMENTS 3,513,757 A * 5/1970 Frank ..... 493/131
3,611,885 A * 10/1971 Paxton ..... 493/142
4,398,901 A * 8/1983 Campbell ..... 493/90
4,581,005 A * 4/1986 Moen ..... 493/167
4,596,542 A * 6/1986 Moen ..... 493/89
4,601,687 A * 7/1986 Gallaher ..... 493/89
5,807,223 A * 9/1998 Holton ..... 493/84
2004/0023768 A1* 2/2004 Jaen ..... 493/55
2005/0137072 A1* 6/2005 Jackson ..... 493/171
2007/0037682 A1* 2/2007 Scholtes et al. ..... 493/175
2008/0081754 A1* 4/2008 Plemons et al. ..... 493/84

* cited by examiner

*Primary Examiner*—Hemant M Desai
(74) *Attorney, Agent, or Firm*—Richard A. Ryan

(57) ABSTRACT

A smart mandrel for use with a container forming machine to form a Bliss style container having one or more structural columns in a side or end of the container. In the preferred embodiment, the mandrel has a frame, a female profile mechanism having a female forming tool fixedly supported by the frame, a male profile mechanism having a male forming tool slidably supported by the frame, an engaging mechanism to hold a side blank against the female forming tool and an actuating mechanism that moves the male forming tool into engagement with the female forming tool to form a column in the side blank. A mandrel carriage moves the formed side blank into engagement with a Bliss style body blank to form the desired container. The engaging mechanism comprises one or more suction cups and the actuating mechanism is a linear actuator having a pneumatic cylinder.

20 Claims, 8 Drawing Sheets

SMART MANDREL FOR CONTAINER FORMING MACHINES

CROSS-REFERENCE TO RELATED APPLICATIONS

This application claims the benefit of U.S. Provisional Patent Application No. 60/811,979 filed Jun. 8, 2006.

BACKGROUND OF THE INVENTION

A. Field of the Invention

The field of the present invention relates generally to Bliss style containers and to the machines that are utilized for forming such containers. More particularly, the present invention relates to apparatuses used for pre-forming and laminating reinforcing pillars or structural columns in the sides or ends of a pre-cut and scored corrugated blank that is utilized to form the Bliss style container. Even more particularly, the present invention relates to such apparatuses that improve the speed and efficiency of forming Bliss style containers.

B. Background

As well understood in the packaging industry, there is an ever increasing need for better containers to hold commodities, including items such as fresh fruits, vegetables, poultry, meat products and a wide variety of other products, which have various sizes, shapes and dimensions. As new products and packaging arrangements are developed, there is a need for new container designs and machinery to manufacture or form the particular design. In the packaging industry, as well as the present disclosure, the terms "container", "case" and "box" are often used interchangeably. These terms each generally refer to a large, usually rectangular container made out of paperboard that is designed to hold a given number or mass of smaller units such as cartons, bottles, cans, chickens, meat or produce pieces.

The packaging industry has developed many different types and styles of fiberboard containers over the years, each being optimally suited for one or more particular products or industries. Such containers are typically constructed of a corrugated material. These materials may be single face corrugated, single wall (double-faced) corrugated, double wall corrugated, triple wall corrugated or the like. Containers may also be made of other paperboard products including, without limitation, containerboard, boxboard, linerboard, and cardboard. To increase top to bottom compression strength of the containers, various types of reinforcing pillars or structural columns have been developed, typically by folding the container material to form corner posts or columns at various points along the side walls of the container.

Specialized box forming machines have been developed over the years to form the different style boxes. Typically, such machines are generally configured in a vertical or horizontal plane, each with their own unique features and benefits. Many attempts have been made to form structural columns in the side walls of Bliss containers, generally by attempting to plough shaped columns by compressing the corrugated board between a male and female form resembling the profile of the structural column. In most configurations, the structural column forming operation is carried out around a mandrel which contains the female profile. The male profile for the column is moved toward the female profile by means of a mechanical linkage or by some configuration of electric and/or pneumatic actuators, thus sandwiching the container material between the mating male and female forms, to provide a column resembling the profile of the forming tool. Generally, the structural columns are angular in shape. To complete formation and the securing of the form, the mandrel moves forward pushing against the inner side of the container body blank. The pre-glued body blank of the Bliss style box wraps around the mandrel and the glue laps that hold the sides in place are ploughed and compressed against the side or end panel thus capturing and maintaining the shape of the column. The above-described operation has also been performed independently of the mandrel as a separate sequence, where the Bliss body blank with the bonded side and formed column is fed into a module containing the mandrel which then completes the final box forming sequence.

The presently available box forming methods have disadvantages, including lack of output speed due to the time it takes to form the column, maintaining the true shape of the column (which is even more difficult when more than one column needs to be formed) and maintaining the shape of the profile while moving the container into the compression phase of the forming process, where the shape of the profile is finally captured. Maintaining the shape of the profile while moving the container is extremely difficult when forming column profiles in container walls that are less than six inches in height. What is needed therefore, is an apparatus for forming profiles in the side and/or end walls of a Bliss style container that overcomes the various disadvantages, as stated above, of presently available container forming machines. The preferred apparatus would allow the user to form containers at speeds in excess of twenty containers per minute while maintaining the true shape of the formed profiles throughout the container forming process. The preferred apparatus will be particularly adaptable to Bliss container forming machines that utilize a feed system that picks and places the side or end wall blanks from the hoppers.

SUMMARY OF THE INVENTION

The smart mandrel for container forming machines of the present invention solves the problems and provides the benefits identified above. That is to say, the present invention discloses a smart mandrel that overcomes the drawbacks of existing methods of forming structural columns in the side or end walls of a Bliss style box. In the present invention, the mandrel that houses the female form of the structural column is mounted to a base plate which in turn is mounted by means of linear slide device to the frame of the container forming machine. This entire apparatus is mounted in-front of the mandrel ahead of the line of feed travel of the Bliss body blank. The male forming device is able to move, on command, in the same plane as that of the mandrel. Generally, the movement of the male forming device would be performed by means such as, but not limited to, a pneumatic cylinder.

In one general aspect of the present invention, the smart mandrel for container forming machines comprises a frame having a plurality of frame members, a female profile mechanism having a female forming tool fixedly supported by the frame, a male profile mechanism having a male forming tool slidably supported by the frame, an engaging mechanism for holding a side blank against the female forming tool and an actuating mechanism configured to move the male forming tool into engagement with the female forming tool with the side blank disposed therebetween to define a column in the side blank. The male forming tool is sized and configured to cooperatively engage the female forming tool. In one embodiment, the male forming tool has a generally V-shaped cross section having an apex that is received in the female forming tool, the engaging mechanism comprises one or more suction cups and the actuating mechanism comprises a linear actuator such as a pneumatic cylinder or the like that is configured to move the male forming tool between a retracted position apart from the side blank and an extended position that engages the side blank and the female profile mechanism to form the column. The mandrel is attached to a mandrel carriage that is configured to move the mandrel toward the container forming machine so as to engage the side blanks with the body blank for forming the desired Bliss style container. The female profile mechanism is mounted to a guide shaft that is supported by the frame.

Accordingly, the primary objective of the present invention is to provide a smart mandrel for container forming machines that provides the advantages discussed above and overcomes the disadvantages and limitations associated with presently available container forming machines.

It is also an important object of the present invention to provide a mandrel for container forming machines that is configured to place one or more columns in the sides and/or ends of a Bliss type of container.

It is also an important object of the present invention to provide a mandrel for container forming machines that is configured to be rapidly shape one or more sides or ends of a container blank to define columns therein so as to increase the strength of a Bliss type of container.

It is also an important object of the present invention to provide a mandrel for container forming machines that comprises a female profile mechanism having a female forming tool and a correspondingly configured male profile mechanism having a male forming tool that engages a side or an end blank therebetween to define a structural column in a side or end wall of a Bliss type container.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment, which represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
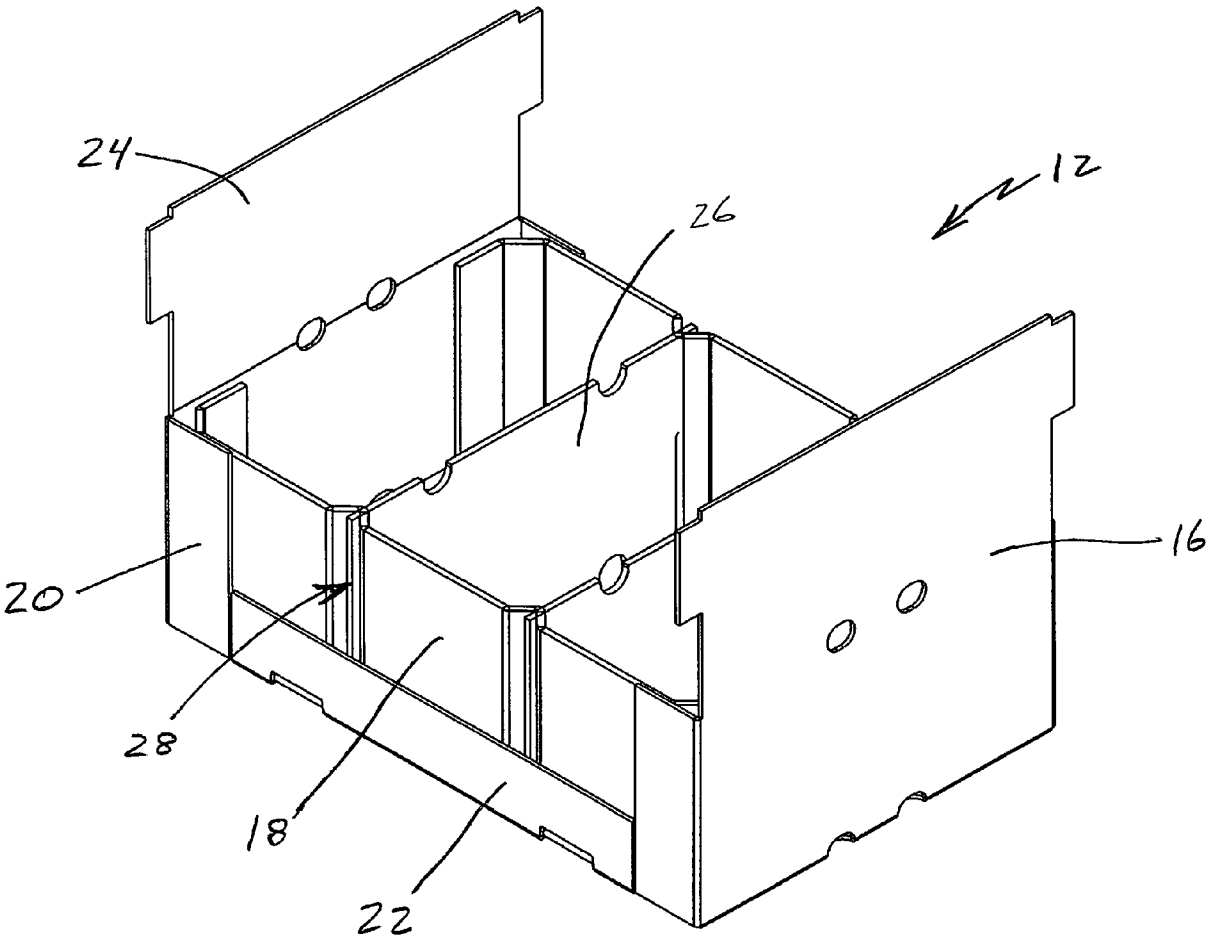
FIG. 1 is a top perspective view of a Bliss style container having structural columns formed by a container forming machine having a mandrel configured according to a preferred embodiment of the present invention.
Figure 2:
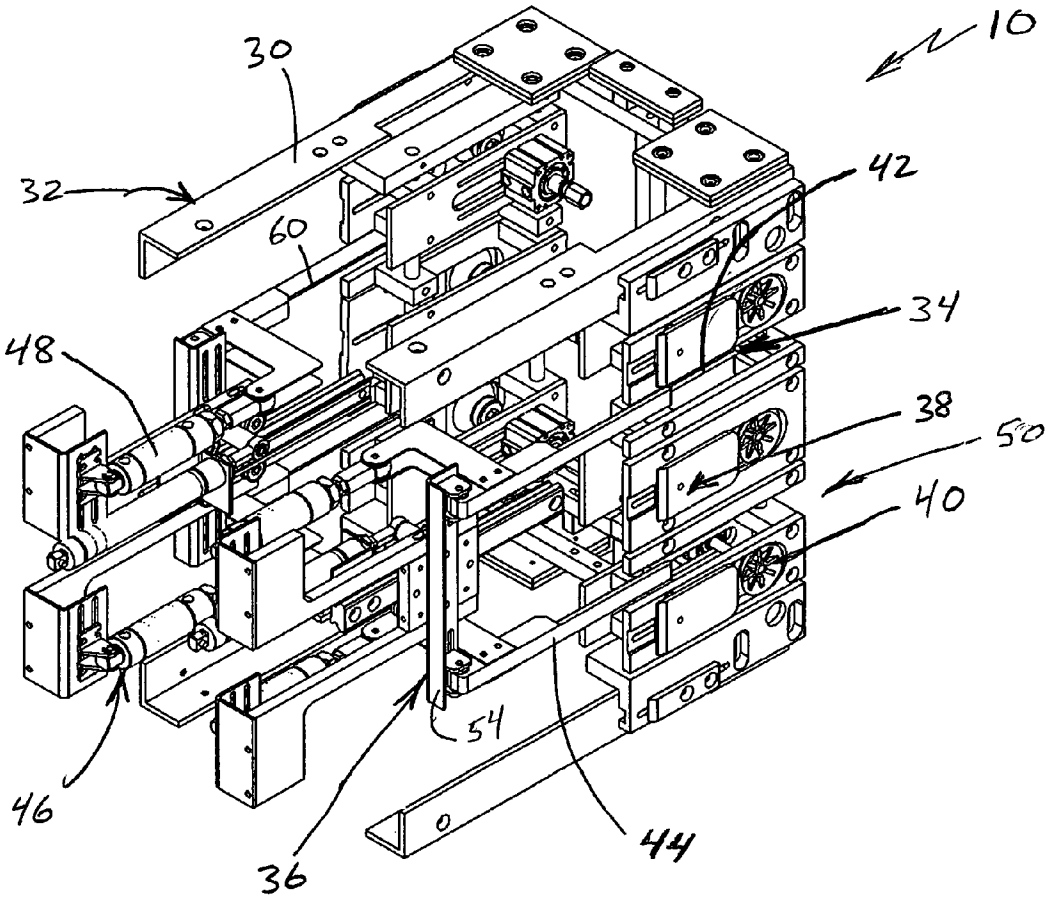
FIG. 2 is a rear perspective view of the smart mandrel configured according to a preferred embodiment of the present invention.

A smart mandrel that is manufactured out of the components and configured pursuant to a preferred embodiment of the present invention is shown generally as 10 in FIGS. 2 through 8. A Bliss style container 12, shown in FIG. 1, is of the type that can be formed by the mandrel 10 in conjunction with the primary compression mechanism 14, shown in FIGS. 6 through 8, of a suitably configured box forming machine. The Bliss style container 12 is formed from a body blank 16, which forms the ends and bottom of container 12, that is securely joined with a pair of side blanks 18. As familiar to those skilled in the art, during the forming process the container 12 is provided with corners 20 and laps 22 that are attached with glue or other adhesive during the forming process or by being provided in a pre-glued condition. The Bliss container 12 of FIG. 1 has lid panels 24 that form a lid for container 12 and a divider 26 interconnecting side panels 18 across the interior of container 12. As known to those skilled in the art, lid panels 24 and divider 26 can be provided or not provided with container 12. The reinforcing pillars or structural columns 28, which provide additional strength to container 12, are beneficially formed, as set forth below, by smart mandrel 10 of the present invention.

As best shown in FIGS. 2 through 5, mandrel 10 comprises a plurality of frame members 30 which define mandrel frame 32 that supports the operation of mandrel 10 with regard to forming columns 28 in side panels 18. Mounted on frame 32 is the female profile mechanism 34 and male profile mechanism 36. In the embodiment shown in the figures, the female profile mechanism 34 is fixedly mounted on frame 32 and the male profile mechanism 36 is slidably mounted on frame 32 to move in the same general direction as the plane formed by the side blank 18 when attached to mandrel 10. Typically, the side blanks 18 are held in place on mandrel 10 against the static picks or stops 38 by a vacuum mechanism, such as the one or more vacuum cups 40 shown mounted on mandrel 10. As known to those skilled in the art, other types of picking and holding mechanism can also be utilized with smart mandrel 10 of the present invention.

Figure 3:
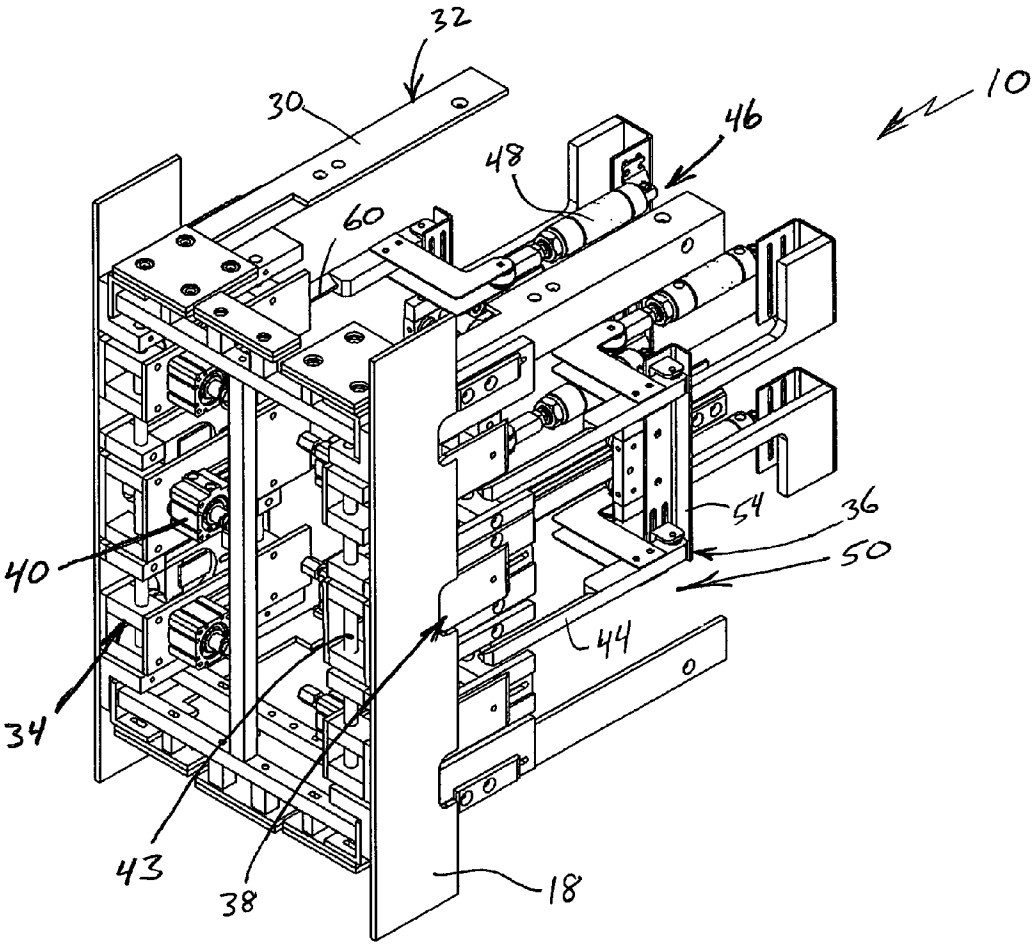
FIG. 3 is a front perspective view of the smart mandrel of FIG. 2 shown with a side blank in position against the female profile.
Figure 4:
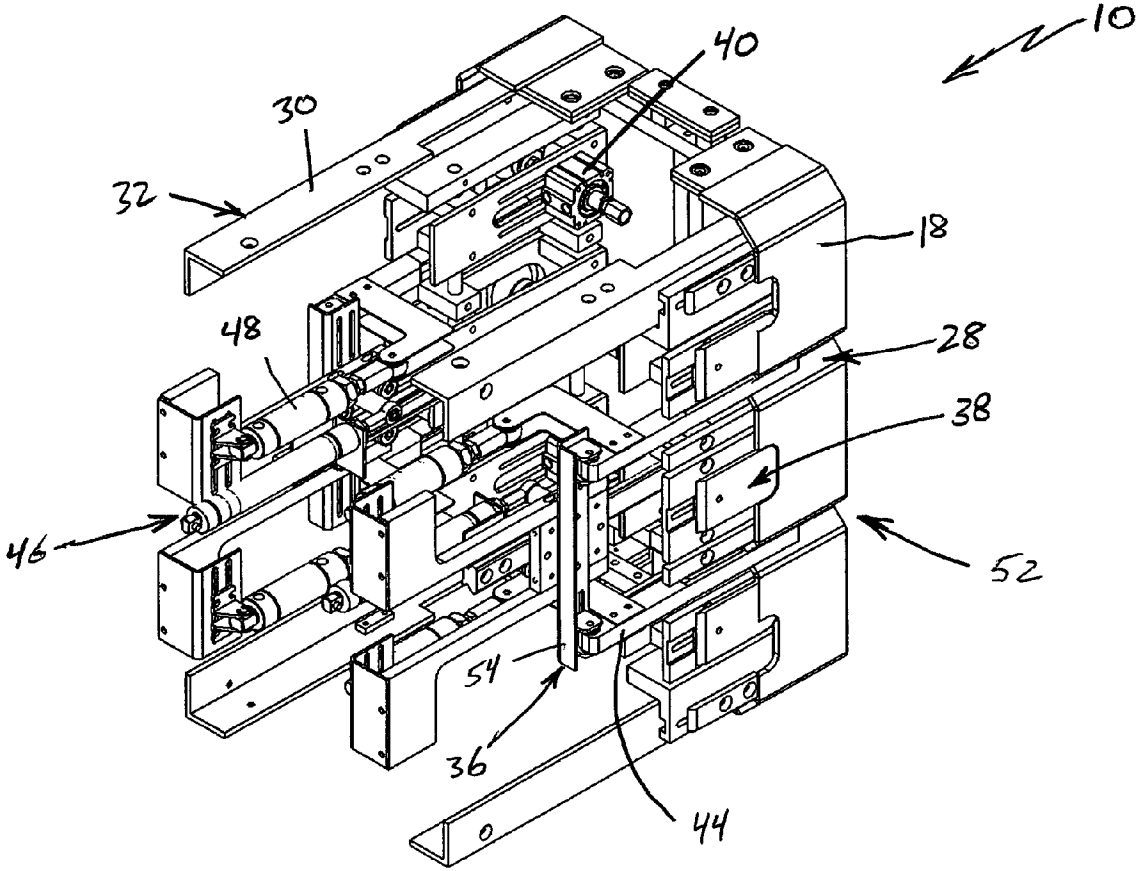
FIG. 4 is a rear perspective view of the smart mandrel of FIG. 3 shown with the male profile mechanism in position against the side blank to form the structural columns.

The female profile mechanism 34 includes a female forming tool 42 that is shaped and configured to correspond to the desired inward facing shape of column 28. Typically, the female forming tool 42 will be mounted on a guide shaft 43 and include an inwardly disposed groove or groove-like shape, as shown in the figures. Male profile mechanism 36 includes a male forming tool 44 shaped and configured to cooperatively engage the female forming tool 42 with side blank 18 disposed therebetween, as best shown in FIG. 4. In the preferred embodiment shown in the figures, male forming tool 42 comprises an elongated member having an inwardly disposed, generally V-shaped profile that is mounted on a bed plate which is attached to guides and housed within frame 30. Male profile mechanism 36 also includes an actuating mechanism 46, which is preferably a linear actuating mechanism comprising a pneumatic cylinder 48 or the like, for moving the male forming tool 44 between its retracted position 50 (FIGS. 2, 3 and 5) and its extended position 52 (FIG. 4) where it engages side blanks 18 over female forming tool 42 to form column 28. Male profile mechanism 36 is configured to advance and retract in the same general plane of travel as mandrel 10, but independently of the forward and backward movement of mandrel 10. In the embodiment shown in FIGS. 2 through 5, male profile mechanism 36 includes a pair of male forming tools 44 that are joined by cross-member 54, which is operatively connected to a linear guide mechanism driven by pneumatic cylinder 48 to jointly drive both male forming tools 44 at the same time so as to form a pair of columns 28. Attached to mandrel 10 is a mandrel carriage 56, shown in FIGS. 6 through 8, that moves the mandrel toward and then back away from the body blank 16 positioned on primary compression mechanism 14, supported by forming machine frame 58, of container forming machine.

Figure 5:
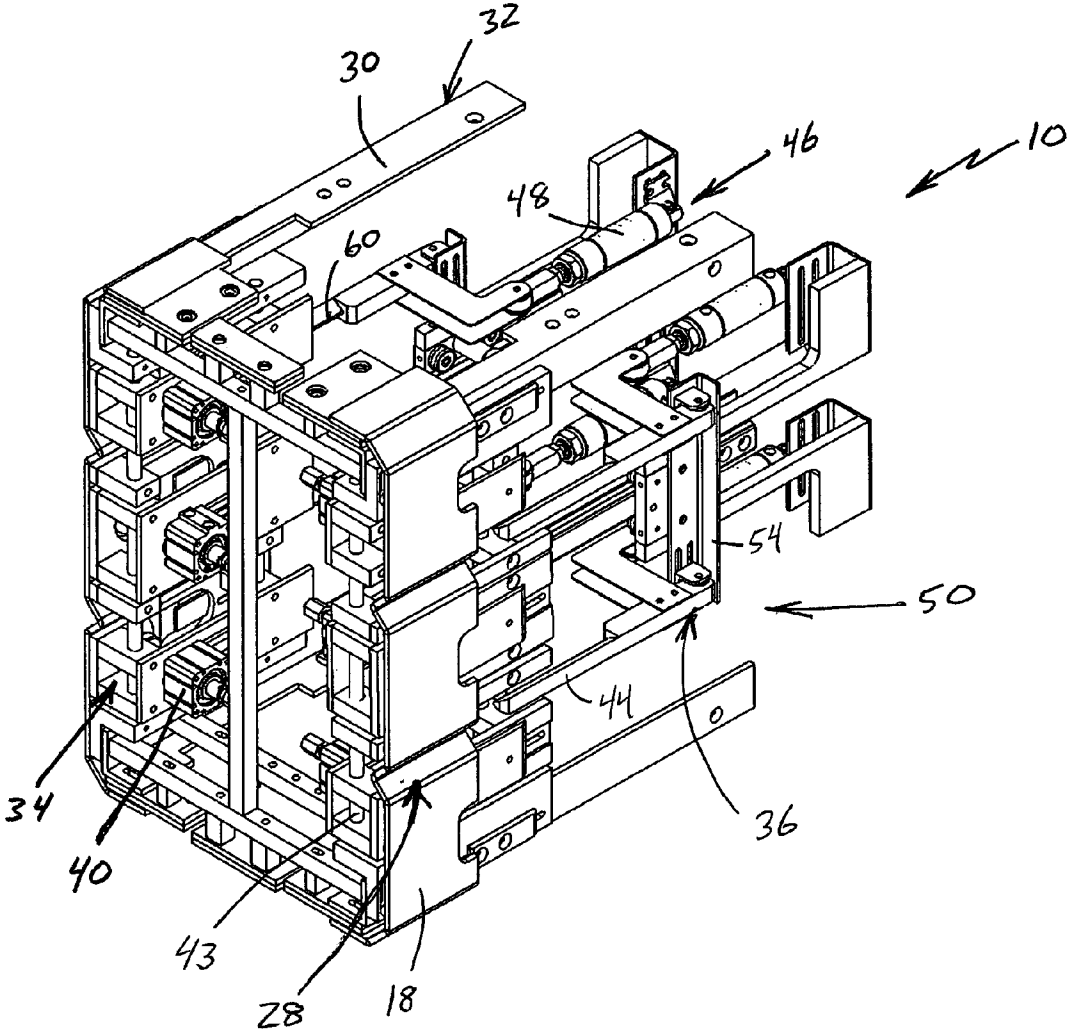
FIG. 5 is a front perspective view of the smart mandrel of FIG. 4 shown with the male profile mechanism retracted from the side blank after forming the structural column.
Figure 6:
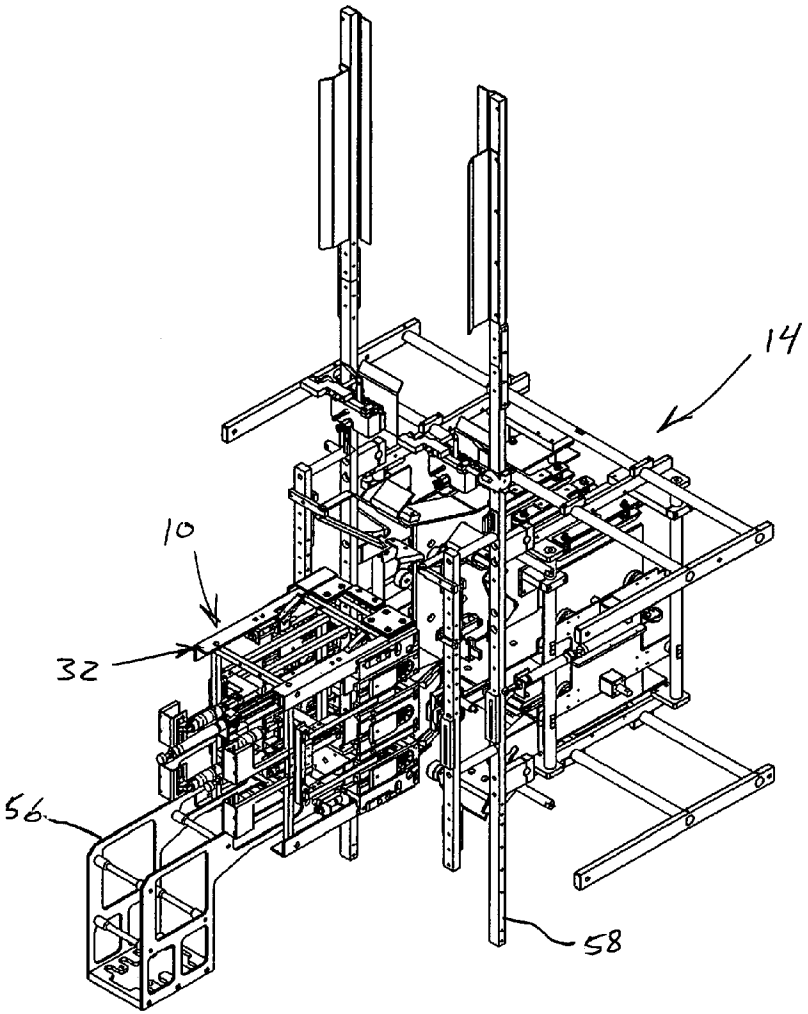
FIG. 6 is a rear perspective view of the smart mandrel of FIG. 2 shown attached to the primary compression mechanism.
Figure 7:
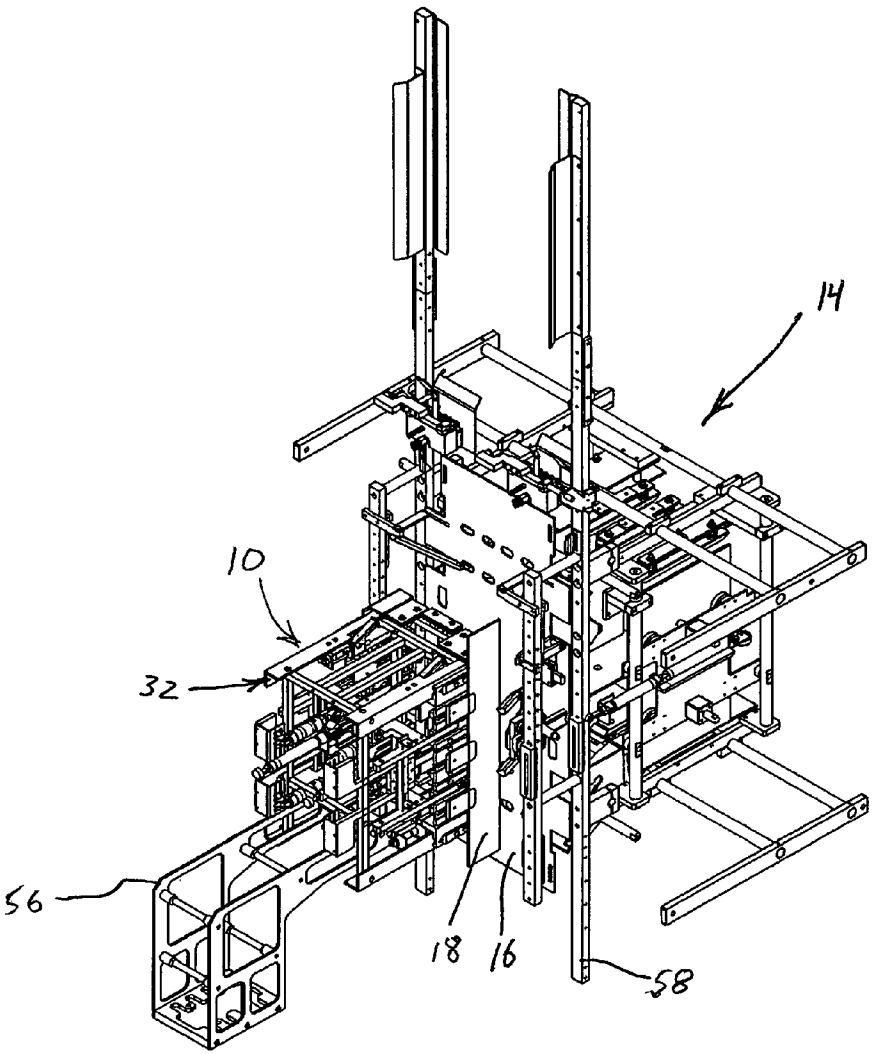
FIG. 7 is a rear perspective view of the smart mandrel and primary compression mechanism of FIG. 5 shown with a side blank and body blank in their respective container forming positions.
Figure 8:
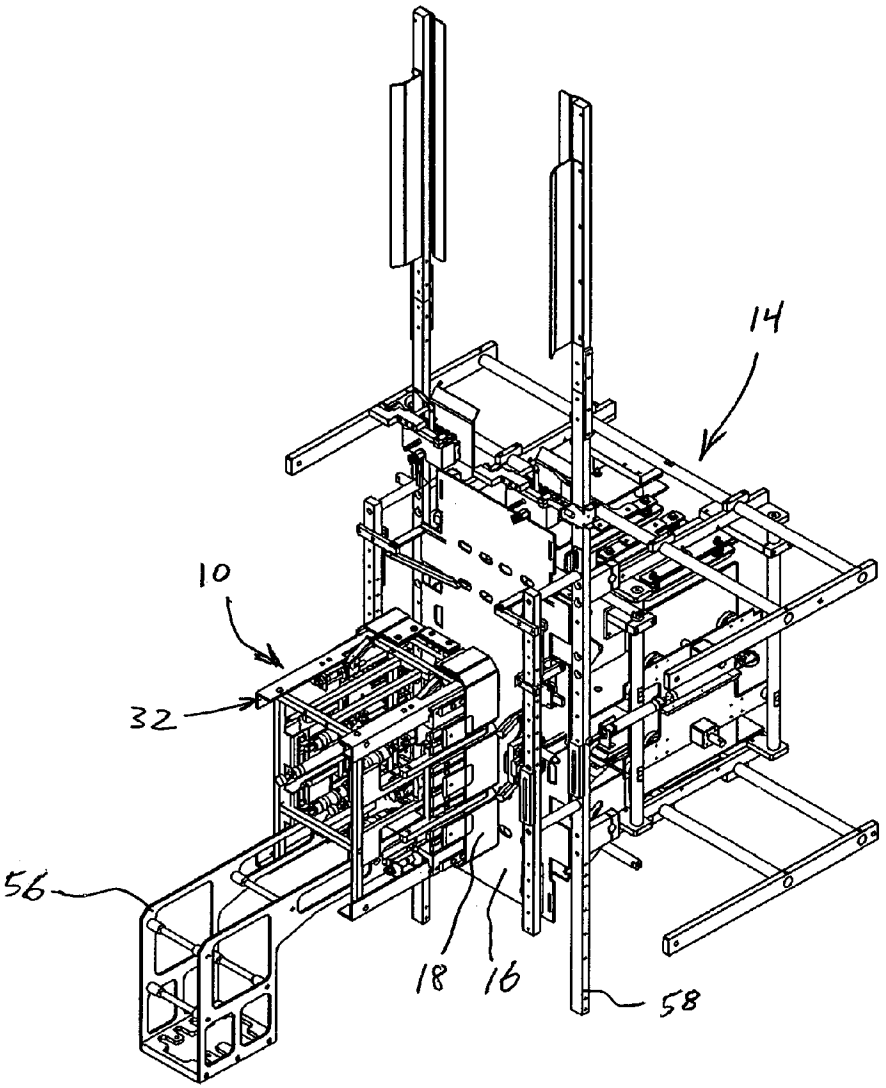
FIG. 8 is a rear perspective view of the smart mandrel and primary compression mechanism of FIG. 6 shown with the male profile mechanism in position against the side blank to form the structural columns.

During the forming process, side blanks 18 for the Bliss container 12 are located in hoppers (not shown) which are positioned at ninety degrees to the plane of travel of the mandrel 10, which is generally left to right in FIGS. 5 through 7. Picks pull the side blanks 18 from the hoppers and place them in position on mandrel 10, as best shown in FIG. 3. Side blanks 18 are held in position against mandrel 10 by vacuum cups 40. The male profile mechanism 36 is held in its retracted or "open" position, with the bedplate retracted, as the side blanks 18 are positioned. Once the vacuum cups 40 take hold of the side blanks 18, the bedplate is moved forward bringing the male forming tool 44 over side blanks 18. When in position, the male forming tools 44 are closed against the sides of side blanks 18, which results in the side blanks 18 being sandwiched between the male 44 and female 42 profile tools. The male forming tools 44 held in the closed position as the mandrel 10 moves forward into the compression mechanism 14. The formed profile for column 28 is securely held until it is fixed by the bonding of the Bliss body blank lap joints. As the mandrel 10 retracts, the male profile mechanism 36 resets to its home, retracted position 50.

In use, prior to mandrel 10 being activated to advance towards the primary compression mechanism 14 of the container forming machine and the body blank 16 of the Bliss style container 12, the side panels 18 are positioned against mandrel 10 by a pick and place mechanism that removes side blanks 18 directly from a hopper, that is usually positioned parallel to the same plane as the direction of movement of mandrel 10. The sides blanks 18 are held in position by an engaging means, such as vacuum cups 40, located within the frame 32 of mandrel 10. The female forming tools 42 are preset to give the correct shape of the form being ploughed by the male forming tools 44. With mandrel 10 loaded with the Bliss side blanks 18, the male forming tools 44 advance forward by way of actuating mechanism 46 (i.e., pneumatic cylinder 48) so that the male forming tools 44 are positioned above each of the Bliss side blanks 18. The pneumatic cylinder 48 is activated, extending the male forming tools 44 towards the female forming tools 42. The apex 60, shown in FIGS. 2, 3 and 5, of the generally V-shaped cross-section of the profiled edge of the male forming tool 44 makes contact with the outer face of the Bliss side blank 18 and squeezes the side blank 18 between it and female forming tool 42 until the desired shape for structural column 28 is achieved. Mandrel 10 then advances forward into the compression chamber of the primary compression mechanism 14 of the container forming machine with the side blanks 18 being held firmly in position between the nip of male 44 and female 42 forming tools. All the pre-glued laps 22 of the Bliss body blank 16 are ploughed by means of a powered compression plate and glued to the ends or sides of the container 12 in which the formed columns 18 have been fully shaped and held firmly in position between the male 44 and female 42 forming tools. The shape of the column 28 is then fixed as part of the completed box 12. The mandrel 10 retracts and the bedplate together with the male forming tools 44 are reset to their home, retracted position 50 ready to begin the forming process for the next container.

Although the foregoing description and the figures included herewith describe and show the columns 28 placed in the side blanks 18 of container 12, those skilled in the art will readily appreciate that the invention is not so limited. If desired, the smart mandrel 10 of the present invention can be utilized to form one or more columns 28 in one or more ends of container 12 in virtually the same manner as described above for side blanks 18. In addition, a plurality of mandrels 10 can be used with a rotary forming machine to form a plurality of containers 12 at the same time (i.e., as the mandrels 10 rotate).

While there are shown and described herein one or more specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A mandrel for use with a container forming machine having a compression mechanism supported by a forming machine frame to form a container from a body blank and one or more side blanks in compression phase, said mandrel comprising:

a mandrel frame having a plurality of frame members, said mandrel configured to move toward and away from said compression mechanism of said container forming machine;

a female profile mechanism supported by said mandrel frame, said female profile mechanism having a female forming tool, said female profile mechanism configured to move with said mandrel;

a male profile mechanism supported by said mandrel frame, said male profile mechanism having a male forming tool sized and configured to cooperatively engage said female forming tool, said male profile mechanism configured to move with said mandrel;

means for engaging one of said side blanks against one of said female forming tool or said male forming tool; and means associated with one of said female profile mechanism or said male profile mechanism for actuating either of said female profile mechanism or said male profile mechanism so as to engage said male forming tool in said female forming tool with said side blank disposed therebetween to define a column in said side blank and maintaining said engaged position of the male and female forming tools while said shaped side blank is moved into position for the compression phase in the compression mechanism.

2. The mandrel according to claim 1, wherein said female profile mechanism is fixedly attached to said mandrel frame and said male profile mechanism is slidably attached to said mandrel frame, said actuating mechanism is associated with said male profile mechanism so as to move said male forming tool between a retracted position apart from said side blank and an extended position that engages said side blank and said female profile mechanism to form said column.

3. The mandrel according to claim 2, wherein said male profile mechanism comprises a pneumatic cylinder.

4. The mandrel according to claim 1, wherein said engaging means comprises one or more suction cups.

5. The mandrel according to claim 4, wherein said engaging means further comprises one or more static picks.

6. The mandrel according to claim 1, wherein said mandrel is attached to a mandrel carriage configured to move said mandrel toward said container forming machine so as to engage said one or more side blanks with said body blank.

7. The mandrel according to claim 1, wherein said male forming tool is configured with a generally V-shaped cross section having an apex that is received in said female forming tool.

8. The mandrel according to claim 1, wherein said female profile mechanism is mounted to a guide shaft supported by said mandrel frame.

9. The mandrel according to claim 1, wherein said male profile mechanism further comprises a cross-member interconnecting said actuating means and a plurality of male forming tools, said female profile mechanism comprising a plurality of female forming tools so as to form a plurality of said columns in said side blank.

10. A mandrel for use with a container forming machine having a compression mechanism supported by a forming machine frame to form a container from a body blank and one or more side blanks in compression phase, said mandrel comprising:

a mandrel frame having a plurality of frame members, said mandrel configured to move toward and away from said compression mechanism of said container forming machine;

a female profile mechanism fixedly supported by said mandrel frame, said female profile mechanism having a female forming tool, said female profile mechanism configured to move with said mandrel;

a male profile mechanism having a male profile tool slidably supported by said mandrel frame, said male profile tool sized and configured to cooperatively engage said female forming tool, said male profile mechanism configured to move with said mandrel;

means for engaging one of said side blanks against said female forming tool; and means operatively connected to said male profile mechanism for actuating said male profile mechanism so as to engage said male forming tool in said female forming tool with said side blank disposed therebetween to define a column in said side blank and maintaining said engaged position of the male and female forming tools while said shaped side blank is moved into position for the compression phase in the compression mechanism.

11. The mandrel according to claim 10, wherein said actuating mechanism comprises a linear actuator configured to move said male forming tool between a retracted position apart from said side blank and an extended position that engages said side blank and said female profile mechanism to form said column.

12. The mandrel according to claim 11, wherein said linear actuator is a pneumatic cylinder.

13. The mandrel according to claim 10, wherein said engaging means comprises one or more suction cups.

14. The mandrel according to claim 10, wherein said mandrel is attached to a mandrel carriage configured to move said mandrel toward said container forming machine so as to engage said one or more side blanks with said body blank.

15. The mandrel according to claim 10, wherein said male forming tool is configured with a generally V-shaped cross section having an apex that is received in said female forming tool.

16. The mandrel according to claim 10, wherein said female profile mechanism is mounted to a guide shaft supported by said mandrel frame.

17. A mandrel for use with a container forming machine having a compression mechanism supported by a forming machine frame to form a container from a body blank and one or more side blanks in compression phase, said mandrel comprising:

a mandrel frame having a plurality of frame members, said mandrel configured to move toward and away from said compression mechanism of said container forming machine;

a female profile mechanism mounted on a guide shaft fixedly supported by said mandrel frame, said female profile mechanism having a female forming tool, said female profile mechanism configured to move with said mandrel;

a male profile mechanism having a male forming tool slidably supported by said mandrel frame, said male forming tool sized and configured to cooperatively engage said female forming tool, said male profile mechanism configured to move with said mandrel;

one or more suction cups configured to hold one of said side blanks against said female forming tool; and a linear actuator operatively connected to said male profile mechanism, said linear actuator configured to move said male forming tool between a retracted position apart from said side blank and an extended position engaged with said female forming tool with said side blank disposed therebetween to define a column in said side blank and configured to maintain said engaged position of the male and female forming tools while said shaped side blank is moved into position for the compression phase in the compression mechanism.

18. The mandrel according to claim 17, wherein said linear actuator is a pneumatic cylinder.

19. The mandrel according to claim 17, wherein said mandrel is attached to a mandrel carriage configured to move said mandrel toward said container forming machine so as to engage said one or more side blanks with said body blank.

20. The mandrel according to claim 17, wherein said male forming tool is configured with a generally V-shaped cross section having an apex that is received in said female forming tool.

* * * * *